US010513788B2

(12) United States Patent
Martin et al.

(10) Patent No.: US 10,513,788 B2
(45) Date of Patent: Dec. 24, 2019

(54) ELECTROLYSIS TANK COMPRISING AN ANODE ASSEMBLY CONTAINED IN A CONTAINMENT ENCLOSURE

(71) Applicant: RIO TINTO ALCAN INTERNATIONAL LIMITED, Montreal (CA)

(72) Inventors: Olivier Martin, Hermillon (FR); Christian Duval, La Rovoire (FR); Steeve Renaudier, Saint Michel de Maurienne (FR); Benoit Bardet, Villagondran (FR)

(73) Assignee: Rio Tinto Alcan International Limited, Montreal (CA)

( * ) Notice: Subject to any disclaimer, the term of this patent is extended or adjusted under 35 U.S.C. 154(b) by 313 days.

(21) Appl. No.: 15/111,486

(22) PCT Filed: Jan. 23, 2015

(86) PCT No.: PCT/IB2015/000072
§ 371 (c)(1),
(2) Date: Jul. 15, 2016

(87) PCT Pub. No.: WO2015/110904
PCT Pub. Date: Jul. 30, 2015

(65) Prior Publication Data

US 2016/0326661 A1 Nov. 10, 2016

(30) Foreign Application Priority Data

Jan. 27, 2014 (FR) ..... 14 00169

(51) Int. Cl.
*C25C 3/12* (2006.01)
*C25C 3/10* (2006.01)
(Continued)

(52) U.S. Cl.
CPC ..... *C25C 3/12* (2013.01); *C25C 3/10* (2013.01); *C25C 3/16* (2013.01); *C25C 3/22* (2013.01)

(58) Field of Classification Search
CPC ..... C25C 3/06–3/24
See application file for complete search history.

(56) References Cited

U.S. PATENT DOCUMENTS 3,575,827 A 4/1971 Johnson
4,247,381 A * 1/1981 Schirnig ..... C25C 3/06 174/152 R (Continued)

FOREIGN PATENT DOCUMENTS

AU 2014/305611 A1 2/2016
WO 2004/035872 A1 4/2004
WO 2015/17922 A1 2/2015

OTHER PUBLICATIONS

May 11, 2015—International Search Report PCT/IB2015/000072.

*Primary Examiner* — Ciel P Thomas
(74) *Attorney, Agent, or Firm* — Banner & Witcoff, Ltd.

(57) ABSTRACT

A cell includes a pot shell defining an opening through which an anode block is designed to be moved, said anode block being suspended from an anode support forming with said anode block an anode assembly mobile in relation to the pot shell, and a confinement chamber defining a closed volume above said opening for the containment of the gases generated during the production of aluminum, the anode support being connected to an electrical conductor to supply an electrolysis current to the anode block, the anode assembly is fully contained in the confinement chamber, and in that the electrical connection between the mobile electrical conductor and the anode support is made within the confinement chamber.

33 Claims, 5 Drawing Sheets

Figure 1:
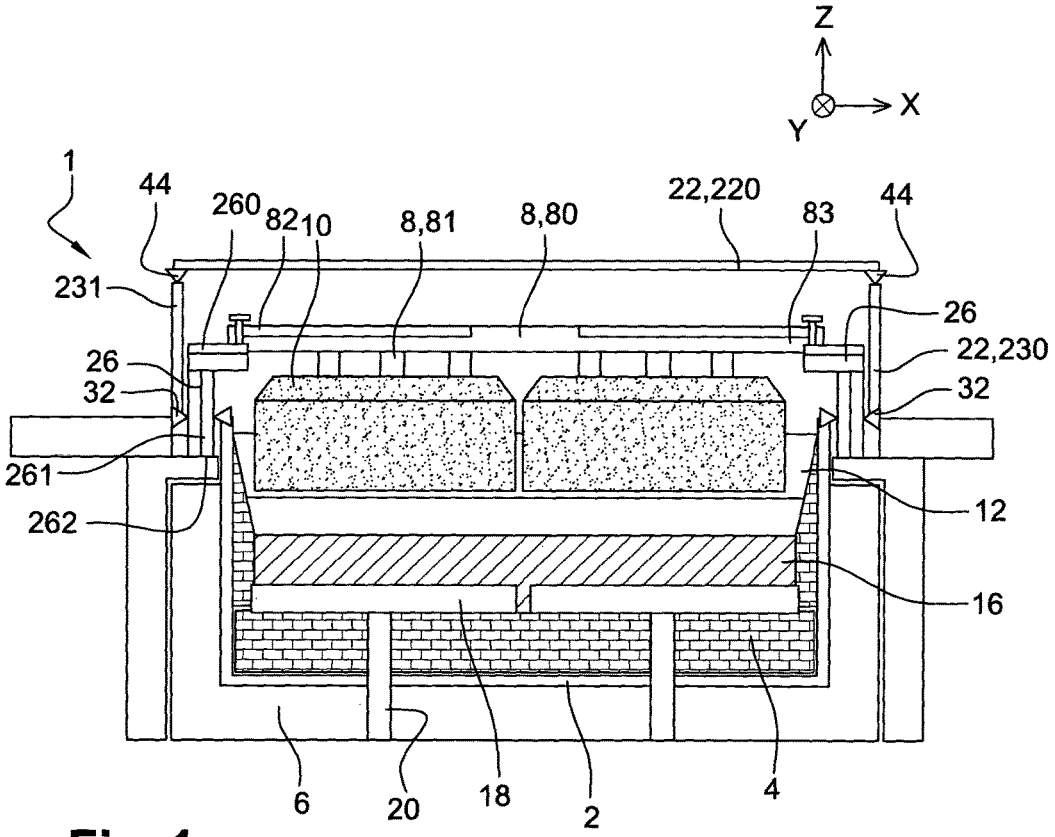

(51) Int. Cl.
*C25C 3/16* (2006.01)
*C25C 3/22* (2006.01)

(56) References Cited

U.S. PATENT DOCUMENTS

| | | | | |
|---|---|---|---|---|
| 4,397,728 | A * | 8/1983 | Pfister | C25C 3/16 204/244 |
| 6,358,393 | B1 * | 3/2002 | Berclaz | C25C 3/08 204/244 |
| 7,678,244 | B2 | 3/2010 | Despinasse et al. | |
| 2006/0137972 | A1 * | 6/2006 | Van Acker | C25C 3/10 204/194 |
| 2013/0181468 | A1 * | 7/2013 | David | C25C 3/16 294/197 |

* cited by examiner

ELECTROLYSIS TANK COMPRISING AN ANODE ASSEMBLY CONTAINED IN A CONTAINMENT ENCLOSURE

CROSS-REFERENCE TO RELATED APPLICATIONS

This application is a U.S. National Stage application under 35 U.S.C. § 371 of International Application PCT/M2015/000072 (published as WO/2015/110904 A1), filed Jan. 23, 2015, which claims priority to French Patent Application No. FR1400169, filed Jan. 27, 2014, and the present application claims priority to and the benefit of both of these prior applications, each of which is incorporated by reference in its entirety.

This invention relates to an electrolytic cell designed for the production of aluminum by electrolysis and an aluminum works, including this electrolytic cell.

It is known that aluminum can be produced industrially from alumina by electrolysis using the Hall-Héroult process. For this purpose an electrolytic cell is used, conventionally comprising a steel pot shell within which there is a lining of refractory materials, a cathode of carbon material, through which pass cathode conductors designed to collect the electrolysis current at the cathode to route it to the cathode collector bars passing through the bottom or the sides of the pot shell, linking conductors extending substantially horizontally to the next cell from the cathode collector bars, an electrolyte bath in which the alumina is dissolved, at least one anode assembly comprising a substantially vertical anode rod and at least one anode block suspended from the anode rod and immersed in the electrolyte bath, an anode frame in which the anode assembly is suspended via the substantially vertical anode rod, mobile with the anode frame in relation to the pot shell and the cathode and flexible risers for the electrolysis current running upwards, connected to the linking conductors from the preceding electrolytic cell, to route the electrolysis current from the cathode collector bars to the anode frame and the anode assembly and anode of the next cell. The anodes are more particularly of the pre-baked anode type with pre-baked carbon anode blocks, i.e. baked before being inserted into the electrolytic cell.

During the electrolysis reaction gases are produced, including carbon dioxide which is released at the anode, and hydrogen fluoride (HF), escaping from the electrolytic bath. To contain the gases so produced, a cover means conventionally covers the opening defined by the pot shell. These gases can then be collected regularly, e.g. for treatment and subsequent recycling.

However, the anode rods pass through the cover means. Dynamic sealing means are generally provided to prevent gas leaks through the junction provided between the cover means and the anode rods. Dynamic sealing means are taken to mean sealing means which ensure containment of the gases when moving the anode rods. Such dynamic sealing means are particularly known from document WO2004/035872 in the name of Aluminum Pechiney. However, during a change of anode, handling the anode rods, which are part of the anode assembly, may cause damage to the dynamic sealing means with which they work in conjunction. Damaged sealing means may affect the sealing of the cover means, so that either the gas generated during the electrolytic reaction cannot be collected in full, or the gas suction system must be oversized.

Furthermore, it is known from U.S. Pat. No. 3,575,827 in the name of Johnson to arrange the electrolytic cells transversely relative to the length of the line that they form, these electrolytic cells comprising an anode assembly with a horizontal plate from which an anode is suspended. This configuration advantageously makes it possible to extract the anodes consumed via the top of the cell. In addition, this document provides for the use of flexible and electrically insulating sheet steel to prevent the escape of gases generated during the electrolysis reaction. These sheets are interposed between the edges of a pot shell and the horizontal plate supporting the anode.

However, the flexible sheets are crushed when the horizontal plate supporting the anode is translated downwardly to move the anode in the electrolytic bath as it is consumed. This crushing generates stresses on the flexible sheets that provide sealing, these stresses being ultimately likely to affect leak tightness. Furthermore, this seal is more difficult to achieve as, for a high-production cell which is therefore of great length with a plurality of anode assemblies, the difference in elevation between two anode assemblies inherent in the process using pre-baked anodes makes this flexible sheet seal difficult to use. In addition, handling the anode assemblies during anode changes may cause damage to the flexible sheets providing sealing.

It should therefore be remembered that the electrolytic cells of prior art include anode assemblies which interact with the cover means, particularly when changing an anode, so that the sealing of the cover means against the gases generated during the electrolysis reaction may be affected.

The present invention aims, then, to eliminate some or all of these disadvantages by providing an electrolytic cell with improved sealing against gas generated during the electrolysis reaction, and an aluminum works comprising said electrolytic cell.

To this end, the present invention relates to an electrolytic cell, for the production of aluminum by electrolysis, comprising a pot shell having an inner lining defining an opening through which at least one anode block is designed to be moved, said anode block being suspended from an anode support forming with said anode block an anode assembly mobile in relation to the pot shell, and a confinement chamber defining a closed volume above said opening for the containment of the gases generated during the production of aluminum, the anode support being connected to an electrical conductor to supply an electrolysis current to said at least one anode block;

characterized in that the anode assembly is fully contained in the confinement chamber, and in that the electrical connection between the mobile electrical conductor and the anode support is made inside the confinement chamber.

In this way, maintaining the integrity of the elements forming the confinement chamber and therefore the containment of the gases generated by electrolysis during the reaction are independent of any manipulation or movement of the anode assembly, so that the electrolytic cell according to the invention provides improved sealing The anode assembly is spaced from the confinement chamber and does not interact with it, which differs from electrolytic cells of prior art.

According to one embodiment, the electrical conductor extends into the confinement chamber outside a volume defined by the top of the anode block during movement of the anode block through the opening.

In other words, the mobile electrical conductor does not extend above the anode blocks in a volume obtained by vertical translation of a projected area of the anode blocks in a horizontal plane.

Electrical connection between the mobile electrical conductor and the anode support is therefore necessarily made on one side of the electrolytic cell, but not above the anode blocks, nor preferably above the opening defined by the pot shell and the lining. The mobile electrical conductor does not interfere with vertical extraction of the anode blocks.

The electrolytic cell is designed to be arranged transversely in relation to the length of a line of electrolytic cells to which it belongs.

According to one embodiment, the confinement chamber comprises a top portion acting as a lid, said top portion being mobile to allow the anode assembly to be extracted. Such a mobile top portion allows maintenance operations to be performed on the cell in operation, including a change of anode assembly, without having to stop the cell or disassemble the equipment necessary for the cell to operate, such as gas suction devices or raw material supply devices. The electrolytic cell of the invention offers the possibility of changing the anodes from the top of the cell, without any of the cell equipment impeding the vertical travel of the anode change, which allows for major structural gains.

According to one embodiment, the electrical conductor is mobile and the confinement chamber comprises a fixed portion having a window through which extends the mobile electrical conductor, the mobile electrical conductor comprising a first portion extending outside the confinement chamber and a second portion extending within the confinement chamber which is electrically connected to the anode support.

In other words, the electrical conductor which is mobile, in particular in vertical translation, passes through the fixed portion of the confinement chamber.

So when changing an anode, there is no need to manipulate the mobile electrical conductor since it passes through the fixed portion of the confinement chamber and not through the mobile top portion, which itself is manipulated to change an anode. This results in simplified and reliable sealing at the window through which the mobile electrical conductor passes.

Advantageously, the electrolytic cell comprises sealing means to prevent gases generated during the electrolysis reaction from leaving the confinement chamber via the window through which the mobile electrical conductor passes.

Sealing is thereby improved.

According to one embodiment, the mobile electrical conductor passes through the fixed portion of the confinement chamber in a substantially vertical way, and the sealing means include a dynamic seal around the mobile electrical conductor.

In this way the seal advantageously remains motionless on the fixed portion of the confinement chamber, while the mobile electrical conductor translates vertically within said seal, which is preferably ring-shaped. This solution has the advantage of being economical. Such a seal is not exposed to impacts due to anode changes, which differs from electrolytic cells of prior art.

The part of the fixed portion of the confinement chamber through which the mobile electrical conductor passes vertically is a horizontal part extending substantially horizontally. The first portion of the mobile electrical conductor extending to the outside of the confinement chamber is arranged below the part of the fixed portion of the confinement chamber through which the mobile electrical conductor passes vertically, while the second portion of the mobile electrical conductor extending within the confinement chamber is arranged above. In other words, the mobile electrical conductor passes through the fixed portion from bottom to top from its first outer portion to its second portion within the confinement chamber. The length of the electrolysis electrical circuit is then minimized.

The mobile electrical conductor preferably comprises, between the second portion and the first portion, a sealing portion designed to work in conjunction with the seal which is rectilinear and of constant section. The leak tightness and simple design of the dynamic seal are therefore improved when such a sealing portion slides through the dynamic seal surrounding it.

According to one embodiment, the mobile electrical conductor passes through the fixed portion of the confinement chamber in a substantially horizontal way, and the sealing means include a sealing component configured to completely close the fixed portion of the window, whatever the position of the mobile electrical conductor through the window.

In this way, leak tightness is ensured in spite of the movement, preferably in vertical translation, of the mobile electrical conductor.

Advantageously, the sealing component surrounds the mobile electrical conductor and is mounted interdependently with the mobile electrical conductor.

The sealing component is therefore mobile concurrently with the mobile electrical conductor. This solution makes it possible to obtain a more effective seal than with a sealing component which is fixed and would have to adapt to the movement of the mobile electrical conductor.

According to one embodiment, the sealing component is a metal plate extending in a plane substantially parallel to the fixed portion through which it passes.

The use of a metal plate has the advantage of reasonable cost while making it possible to withstand, without any performance loss in terms of sealing, the high temperatures generated by the electrolytic cell when in operation, up to several hundred degrees Celsius inside the electrolytic cell.

Advantageously, a compensating component is arranged between the sealing component and the mobile electrical conductor.

This compensating component permits expansion of the mobile electrical conductor and/or of the plate on account of the heat generated by the electrolytic cell in operation while filling any gap between the mobile electrical conductor and the metal plate, which contributes to sealing the confinement chamber.

According to one embodiment, the electrolytic cell comprises means for guiding the sealing component in translation, the guiding means comprising two substantially rectangular frames fixed against the fixed portion of the confinement chamber so as to surround the window of the fixed portion and arranged relative to each other so as to define between them a space within which the sealing component is designed to slide, the electrolytic cell further comprising means for expansion compensation interposed between the two frames.

In this way, this solution provides efficient and economic guiding for the metal plate, and helps maintain the seal despite the high temperatures generated by the electrolytic cell when in operation, through the use of the expansion compensating means, such as flexible seals or brushes, making it possible to absorb the dimensional changes of the frames and/or the metal plate while conserving the seal.

Advantageously, the electrical conductor is a non-deformable rigid electrical conductor. The mobile electrical conductor is not flexible and cannot be deformed so that cooperation between the mobile electrical conductor and the sealing means is facilitated.

According to one embodiment, the anode assembly is supported by the second portion of the electrical conductor and moved via the electrical conductor.

In this way, the electrolytic cell may advantageously be free of a support device for the anode assembly other than the mobile electrical conductor(s), such a device being capable of affecting the sealing of the confinement chamber, for example, if it passes through this confinement chamber.

Advantageously, the electrolytic cell comprises movement means for moving the electrical conductor in substantially vertical translation, the movement means being integrally arranged outside of the confinement chamber.

The movement applied by the movement means of the mobile electrical conductor is then indirectly transmitted to the anode support via the non-deformable rigid mobile electrical conductor.

Advantageously, the mobile electrical conductor is attached to the moving means outside the confinement chamber.

This configuration simultaneously provides the advantage of limiting exposure of the movement means to the high temperatures and the gases generated by the electrolytic cell when in operation at a low cost, while making it possible to indirectly move the anode assembly, via the mobile electrical conductor supporting it. The use of moving means directly causing the anode assembly to move across the confinement chamber, affecting the sealing of the confinement chamber, can therefore be avoided. According to one embodiment, the moving means is a jack specifically associated with the mobile electrical conductor acting as a support for the anode assembly.

The mobile electrical conductor provides three functions as it interacts with the anode assembly. It electrically connects the anode assembly to the electrical conductors arranged outside the confinement chamber, supports it and causes it to move.

The mobile electrical conductor may be a one-piece or composite electrical conductor with, for example, a steel structure mainly dedicated to supporting the anode assembly and to transmitting the movement, and a copper or aluminum structure mainly dedicated to electrical conduction.

Advantageously, the electrical conductor does not extend in line above said anode assembly, specifically said anode support and anode block. In other words, the mobile electrical conductor extends outside of a volume obtained above the anode assembly by vertical translation of a projected area of the anode assembly in a horizontal plane.

In this way, the mobile electrical conductor is outside the vertical trajectory of said anode assembly during withdrawal so that no manipulation of the mobile electrical conductor is necessary when changing an anode. This also helps prevent the risk of affecting the leak tightness of the confinement chamber.

Advantageously, the electrical conductor is arranged under the anode support of the anode assembly.

In this way, the anode support can rest by gravity on the mobile electrical conductor, so that the latter does not prevent withdrawal vertically by the top of the anode assembly, for example for changing an anode.

No handling of the mobile electrical conductor is required during an anode assembly extraction operation, which advantageously prevents any risk of affecting the leak tightness of the confinement chamber. Only vertical repositioning of the mobile electrical conductor is performed by the moving means to accommodate a new anode, whose carbon height is much greater than that of a spent anode.

According to one embodiment, the top portion of the confinement chamber rests on the fixed portion of the confinement chamber.

The fixed portion defines a substantially rectangular horizontal opening and the top portion rests substantially horizontally on the fixed portion.

Advantageously, the electrolytic cell comprises sealing means interposed between the top portion and the fixed portion.

This helps to improve the sealing of the confinement chamber at the junction between the mobile top portion and the fixed lateral portion which corresponds to a substantial part of the confinement chamber.

According to one embodiment, the electrolytic cell comprises compression means for maintaining the top portion pressed against the fixed portion.

In this way, the compression means hold the top portion in contact with the fixed portion, to improve sealing of the confinement chamber at the junction between the mobile top portion and the fixed lateral portion.

This embodiment is particularly advantageous since sealing means are interposed between the top portion and the fixed portion.

According to one embodiment, the top portion comprises a plurality of adjacent hoods substantially longitudinal and parallel to each other, extending in a direction substantially transverse to the electrolytic cell, between two opposite longitudinal edges of the electrolytic cell.

According to one embodiment, the electrolytic cell comprises means of fixing the anode support onto the electrical conductor, the fixing means being completely contained inside the confinement chamber.

This improves the electrical connection between the anode support and the corresponding electrical conductor.

The fixing means may comprise two complementary threads whose cooperation allows the anode support and the electrical conductor to be fixed simply by screwing.

The fixing means may comprise a screw connector providing compression of the anode support against the mobile electrical conductor.

According to one embodiment, the electrolytic cell comprises a plurality of anode assemblies and, for each anode assembly, at least one electrical conductor electrically connected to the anode support.

According to one embodiment, the anode support comprises a bar which extends substantially horizontally between two opposite longitudinal edges of the electrolytic cell.

According to one embodiment, each of the opposite ends of the bar is electrically connected to an electrical conductor.

According to one embodiment, each of the opposite ends of the bar is supported by the second portion of an electrical conductor and moved via this electrical conductor.

According to one embodiment, the top portion of the confinement chamber is designed to allow the anode assembly to be withdrawn by upward vertical translation of the anode assembly and to be inserted by downward vertical translation of the anode assembly.

According to one embodiment, the fixed portion of the confinement chamber comprises a vertical portion extending substantially vertically around and above the opening defined by the pot shell and the inner lining. This vertical part forms an inner volume permitting movement of the anode assembly in the confinement chamber for operation of the electrolytic cell. According to one embodiment, the mobile electrical conductor has a portion of polygonal section.

In this way, rotation of the mobile electrical conductor around the axis in which it extends, in relation to the sealing means is prevented.

According to another aspect of the present invention, the latter relates to an aluminum works comprising at least one electrolytic cell having the above characteristics.

The aluminum works may include a plurality of electrolytic cells, including said at least one electrolytic cell, forming a line, the electrolytic cells being arranged transversely in relation to the length of the line they form.

Figure 2:
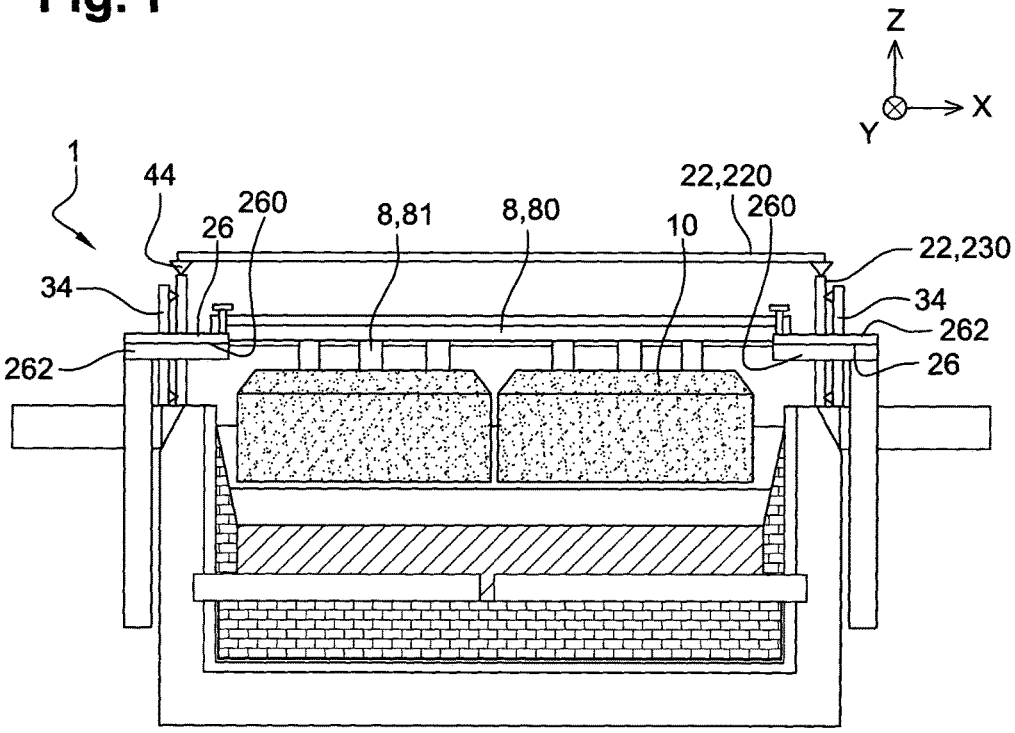
Figure 3:
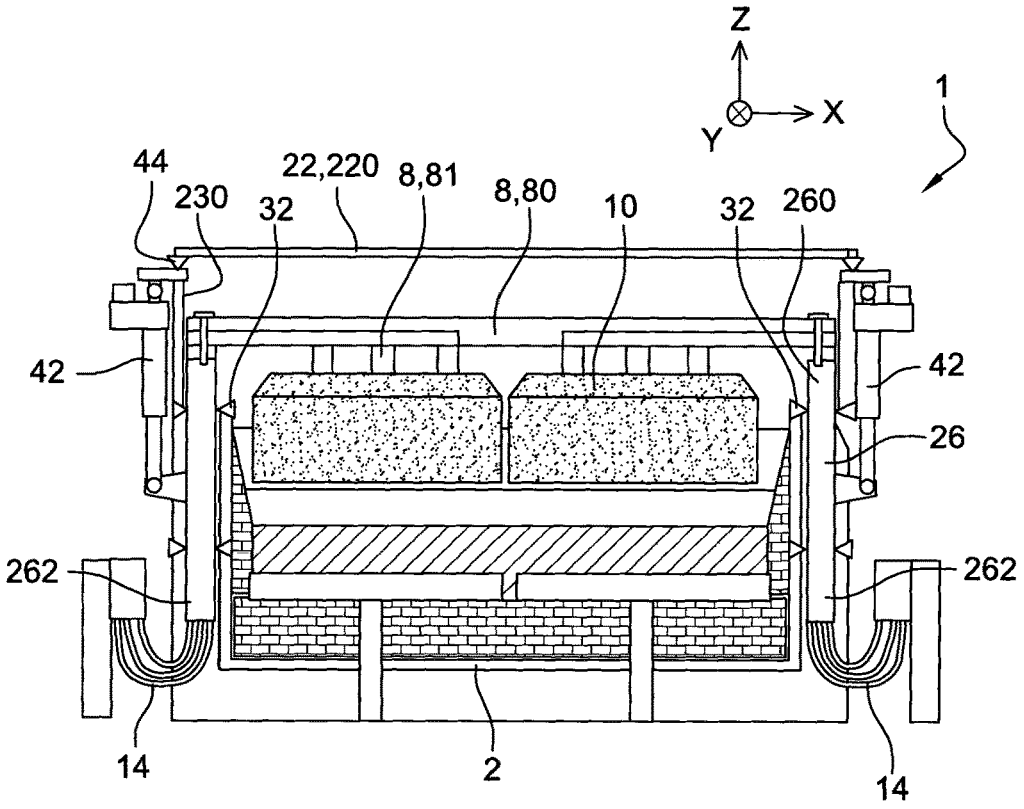
Figure 9:
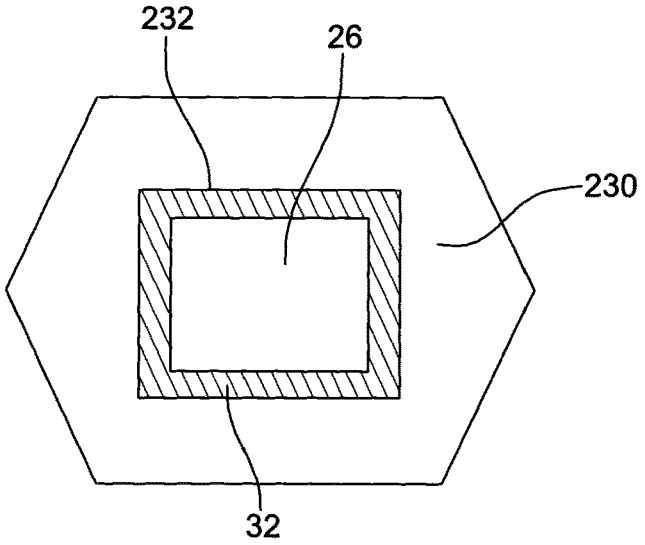
Figure 4:
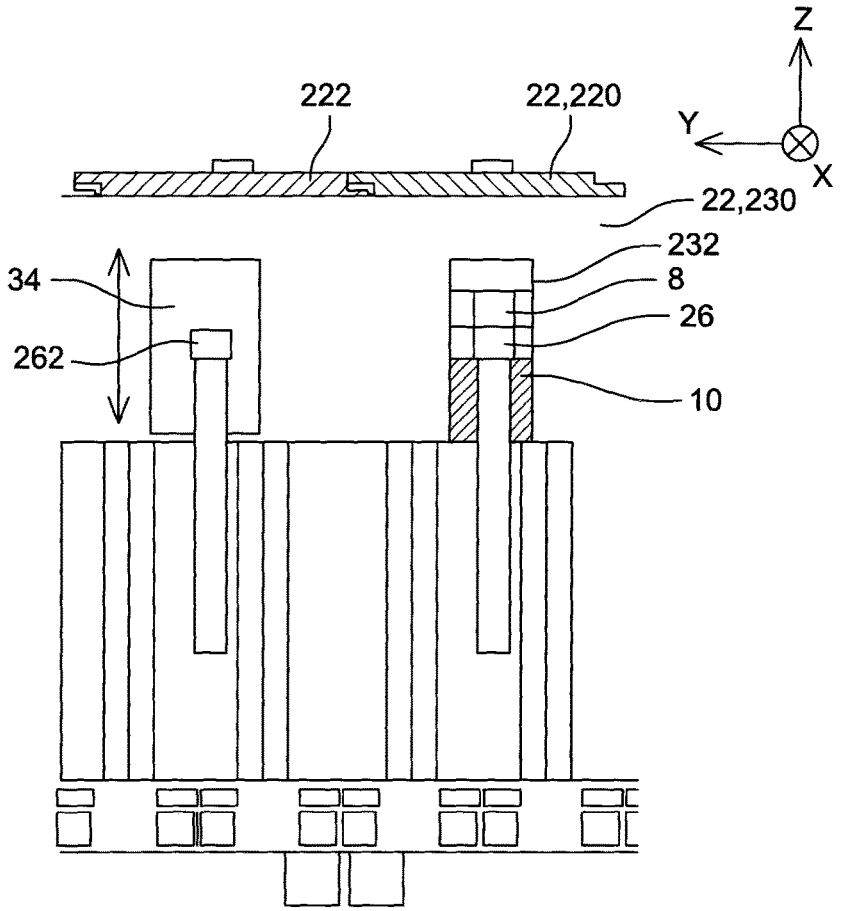
Figure 5:
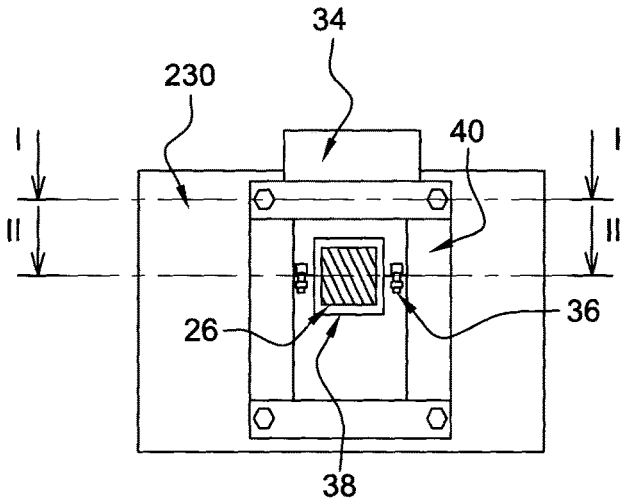
Figure 7:
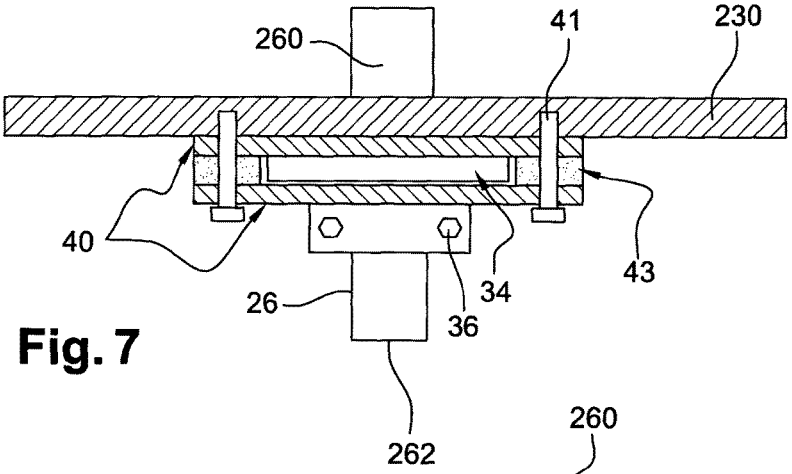
Figure 8:
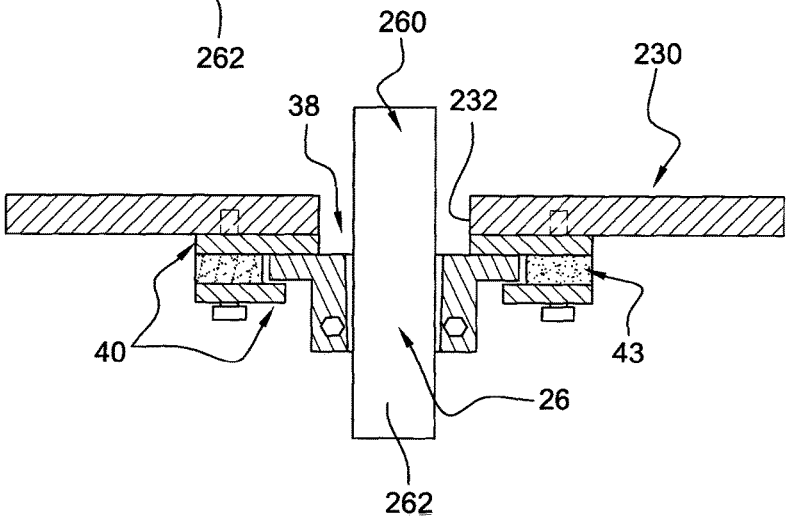
Figure 6:
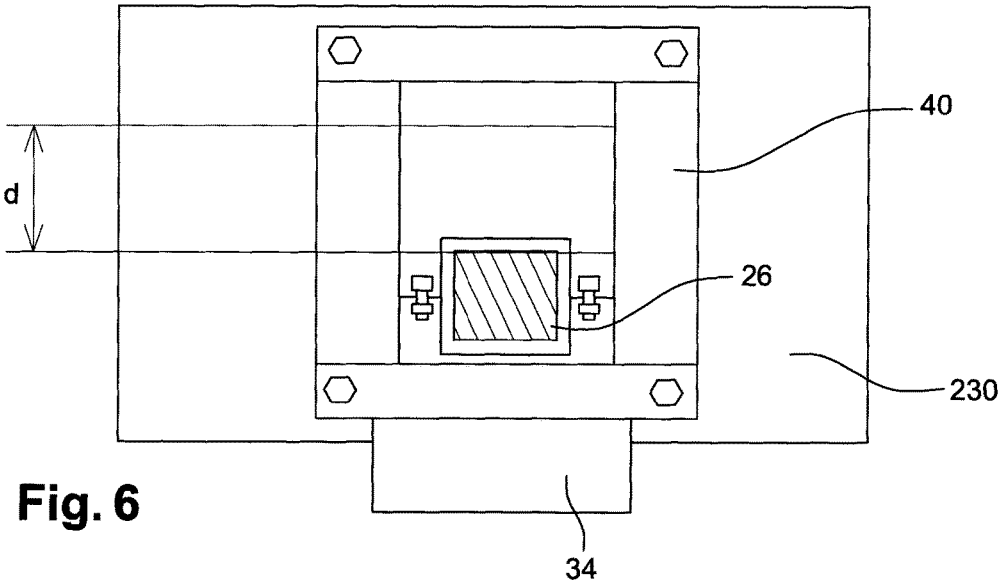
Figure 10:
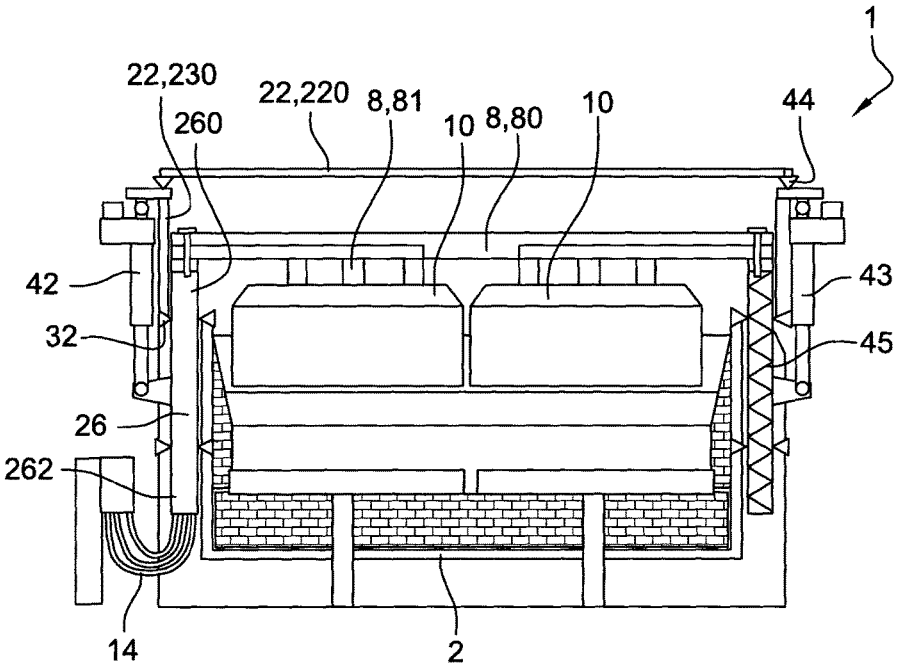
Figure 11:
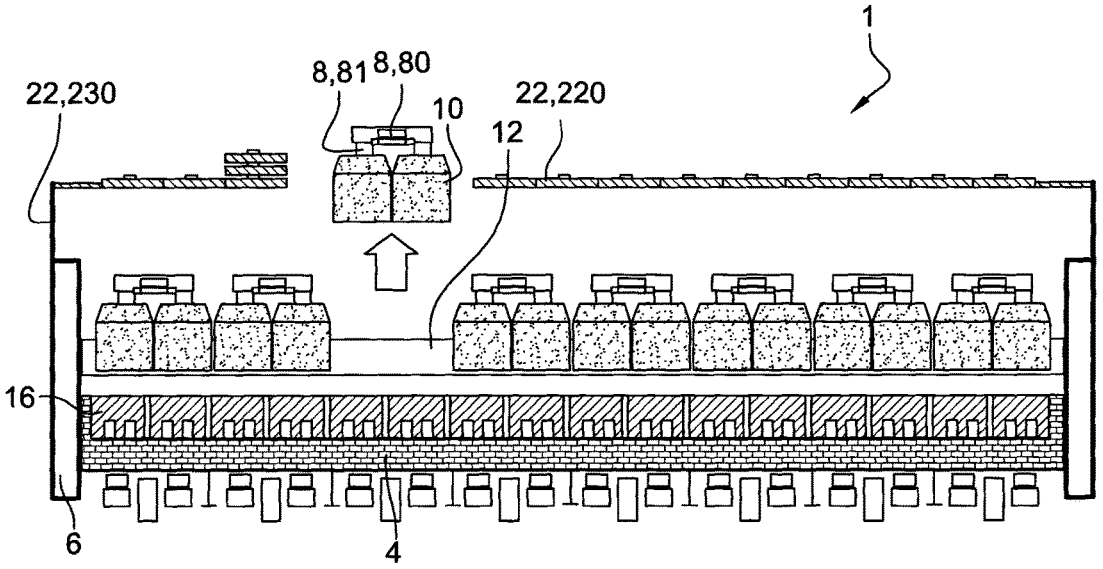

Other features and advantages of this invention will be clearly apparent from the following detailed description of an embodiment of the invention provided by way of a non-limiting example with reference to the appended drawings, in which:

FIG. 1 is a vertical sectional view, in a transverse plane of the electrolytic cell, of an electrolytic cell according to one embodiment of the invention, FIG. 2 is a vertical sectional view, in a transverse plane of the electrolytic cell, of an electrolytic cell according to one embodiment of the invention, FIG. 3 is a vertical sectional view, in a transverse plane of the electrolytic cell, of an electrolytic cell according to one embodiment of the invention, FIG. 4 is a side view of a part of an electrolytic cell according to one embodiment of the invention, in a longitudinal plane of the electrolytic cell, FIGS. 5 and 6 are side views of a part of an electrolytic cell according to one embodiment of the invention, in a longitudinal plane of the electrolytic cell, according to two distinct positions, FIG. 7 is a sectional view along the line I-I in FIG. 5, FIG. 8 is a sectional view along the line II-II in FIG. 5, FIG. 9 is a sectional view according to a substantially horizontal plane of a detail in FIG. 3, FIG. 10 is a vertical sectional view, in a transverse plane of the electrolytic cell, of an electrolytic cell according to one embodiment of the invention, FIG. 11 is a vertical sectional view, in a longitudinal plane of the electrolytic cell, of an electrolytic cell according to one embodiment of the invention, FIG. 1 shows an electrolytic cell 1 according to one embodiment of the invention. Electrolytic cell 1 is designed for the production of aluminum by electrolysis.

It is pointed out that the description is provided in relation to a Cartesian frame of reference relating to an electrolytic cell, the X axis being orientated in a transverse direction of the electrolytic cell, the Y axis being orientated in a longitudinal direction of the electrolytic cell and the Z axis being orientated in a vertical direction of the electrolytic cell. Longitudinal, vertical and transverse orientations, directions, plans and movements are defined relative to this standard.

Electrolytic cell 1 is designed to be arranged transversely in relation to the length of a line of electrolytic cells to which it belongs. It therefore extends lengthwise along the longitudinal direction Y while the line of electrolytic cells extends lengthwise along the transverse direction X.

As can be seen in FIGS. 1 to 3, electrolytic cell 1 comprises a pot shell 2, which may be metallic, for example made of steel, and an inner coating 4, typically made of refractory materials. Pot shell 2 is here equipped with reinforcement cradles 6. Pot shell 2 and its inner lining 4 define an opening through which a plurality of anode assemblies are designed to extend. These anode assemblies include an anode support 8 and at least one anode block 10 or anode, supported by the anode support 8. The anode support comprises for example a support bar 80 which may extend substantially horizontally between two opposite longitudinal edges of the electrolytic cell and stubs 81. The anode block 10 is more especially attached to the anode support 8 by means of stubs 81 sealed with cast iron in holes provided for this purpose in the anode block 10.

The anode or anode block 10 is particularly made of carbonaceous material, and more particularly of the prebaked type. When in operation, it is designed to be immersed in an electrolytic bath 12 and to be consumed there. The anode assemblies are designed to be removed and replaced periodically as the anodes 10 are spent.

Due to the consumption of the anode blocks 10 as the electrolysis reaction proceeds, electrolytic cell 1 comprises means for moving the anode assemblies, enabling the anode assemblies to be translated substantially vertically only. These moving means will be described in more detail below.

Electrolytic cell 1 comprises flexible electrical conductors 14 which may extend either side of the electrolytic cell 1, as is seen in particular in FIG. 3, at the two longitudinal edges of the electrolytic cell 1.

According to the example in FIG. 10, the flexible electrical conductors 14 may extend from a single side of the electrolytic cell 1, at one of the two longitudinal edges of the electrolytic cell 1, and also upwards.

The flexible electrical conductors 14 are designed to lead the electrolysis current to the anode blocks 10, from the routing electrical conductors (not shown) of a previous electrolytic cell in the line, given the overall flow direction of the electrolysis current, while assisting and adapting by means of their flexibility to the vertical translation movement of the anode assemblies. In other words, the flexible electrical conductor 14 has two ends which can move vertically relatively to each other, while ensuring a permanent electrical connection. The flexible electrical conductors 14 may correspond to a superposition of electrically conductive flexible sheets.

Electrolytic cell 1 further comprises a cathode 16, optionally formed of several cathode blocks made of carbonaceous material, and through which the cathode conductors 18 designed to collect the electrolysis current to route it to the cathode outputs 20 passing through pot shell 2 and connected to connecting conductors (not shown) in turn leading the electrolysis current to the flexible electrical conductors 14 of a subsequent electrolytic cell in the line.

Cathode conductors 18, cathode outputs 20 and linking conductors, may take the form of metal bars, made, for example of aluminum, copper or steel.

Electrolytic cell 1 includes a confinement chamber 22 for containment of the gases generated during the electrolysis reaction. This confinement chamber defines a closed volume above the opening in the pot shell and the inner liner, through which an anode assembly is designed to be moved. This confinement chamber 22 may at least in part be the same as the pot shell and a superstructure of the electrolytic cell 1. The confinement chamber 22 comprises a mobile top portion 220 forming a lid arranged above a fixed portion 230.

The fixed portion 230 comprises more particularly the pot shell 2 and a substantially vertical wall 231 extending around the opening above the pot shell 2. The substantially vertical wall 231 bears for example on the top edges of pot shell 2. The fixed portion 230 is advantageously rigid, the wall 231 being immobile relative to pot shell 2.

The top portion 220 is mobile to allow the anode assemblies to be extracted by pulling them substantially vertically by the top above the electrolytic cell 1, as shown in FIG. 11. The fixed portion 230 forms an interior volume making it possible to extract the anode assembly by upward vertical translation of the anode assembly and to insert the anode assembly by downward vertical translation of the anode assembly. An exclusively vertical movement of the anode assemblies above the opening encounters no obstacles.

Note that the anode assemblies are fully contained in the confinement chamber 22.

Electrolytic cell 1 also comprises mobile electrical conductors 26, designed to lead the electrolysis current to the anode support 8, from the flexible electrical conductors 14. The mobile electrical conductors 26 include a second portion 260 arranged within the confinement chamber 22 which is electrically connected to the anode assembly, particularly to the anode support 8, and more particularly to one end of the support bar 80.

The mobile electrical conductor 26 also include a first portion 262 arranged outside of the confinement chamber 22 which is electrically connected to the flexible electrical conductors 14.

The mobile electrical conductors 26 are advantageously rigid, non-deformable electrical conductors. The mobile electrical conductors 26 may correspond, for example, to a metal support bar, in particular made of steel, copper, aluminum or a steel/copper composite.

The mobile electrical conductor(s) 26 extend outside the pot shell 2, without extending in line with the opening defined by the pot shell 2 and its inner lining 4, above the latter, so that the electrical connection between the mobile electrical conductor(s) 26 and the corresponding anode support 8 is necessarily made to one side of the electrolytic cell 1, but not above the opening defined by the pot shell 2. In this way, as can be seen in FIG. 10, no obstacle hinders the extraction of the anode blocks 10 above the electrolytic cell 1.

In this way, the mobile electrical conductors 26 are used to route the electrolytic current from outside the confinement chamber 22 to the anode assembly fully contained within the confinement chamber 22.

The mobile electrical conductors 26 are mobile concomitantly with the anode assembly. In this way, they are designed to be translated substantially vertically as the anodes 10 are consumed.

The flexible electrical conductors 14 are arranged outside the confinement chamber 22. Each flexible electrical conductor 14 is electrically connected to a mobile electrical conductor 26 and adapts to the movement of the mobile electrical conductor 26 and the associated anode assembly.

The second portion 260 of the mobile electrical conductors 26 extends within the confinement chamber 22, so that electrical connection with the anode support 8 is provided inside the confinement chamber 22.

In this way, according to the invention, the anode assembly is free of any interaction with the confinement chamber 22, so that the confinement chamber 22 is not likely to be affected either by the replacement of the anode assembly or by the movement of the anode assembly downwardly as its anode block(s) 10 is (are) consumed.

As shown in FIGS. 1 to 10, the fixed portion 230 of the confinement chamber 22 has a window 232 across which extends a mobile electrical conductor 26 moving vertically. The first portion 262 of the mobile electrical conductor 26 extends within the confinement chamber 22, whereas its second portion 260 extends inside the confinement chamber 22. In other words the mobile electrical conductor 26 passes through the fixed portion 230 of the confinement chamber 22.

Electrolytic cell 1 then advantageously comprises sealing means to prevent gas generated in the course of the electrolysis reaction from leaving the confinement chamber 22 through window 232 through which the mobile electrical conductor 26 passes.

According to the examples in FIGS. 1, 3, 9 and 10, the mobile electrical conductors 26 pass through the fixed portion 230 of the confinement chamber 22, and more particularly the window 232, substantially vertically and move vertically in translation.

The part of the fixed portion 230 of the confinement chamber through which the mobile electrical conductor 26 passes vertically is a horizontal part extending substantially horizontally. This horizontal part of the confinement chamber 22 may be for example a ledge on the upper edges of the pot shell 2 or a horizontal wall attached to the upper edges of pot shell 2. The first portion 262 of the mobile electrical conductor extending to the outside of the confinement chamber is arranged below the part of the fixed portion 230 of the confinement chamber 22 through which the mobile electrical conductor 26 passes vertically, while the second portion 260 of the mobile electrical conductor 26 extending within the confinement chamber 22 is arranged above. In other words, the mobile electrical conductor 26 passes through the fixed portion from bottom to top from its first outer portion 262 to its second portion 260 within the confinement chamber. The length of the electrolysis electrical circuit is then minimized.

The sealing means here comprise a dynamic seal 32 surrounding the electrical conductor 14 moving in vertical translation.

This ring-shaped dynamic seal 32 may for example consist of metal strips, brushes or a flexible or resilient material resistant to temperature and gases. In addition, these seals 32 will have very low aging because they are not exposed to impacts.

The mobile electrical conductor 26 has, between the second portion 260 and the first portion 262, a sealing portion 261 designed to cooperate with the seal 32. This sealing portion is preferably straight and of constant cross section, so as to improve sealing and facilitate the design of the dynamic seal.

According to the example in FIGS. 2, and 4 to 8, the mobile electrical conductors 26 pass through the fixed portion 230 of the confinement chamber 22, and more particularly the window 232, substantially vertically and move vertically in translation. The window 232 is particularly formed in a portion or wall 231 of the substantially fixed portion 230.

The sealing means then comprise a sealing component 34 configured to completely close the window 232 of the fixed portion, regardless of the position of the mobile electrical conductor 26 through the window 232.

This is because the mobile electrical conductors 26 are mobile, with the anode assembly, between a first position, or high position (FIG. 5), in particular corresponding to a position wherein the anode assembly comprises a new anode block 10, and second position, or low position (FIG. 6), corresponding in particular to a position in which the anode block 10 is spent and must be replaced. The difference between these two positions defines a vertical clearance of the mobile electrical conductor 26 to be permitted by the window 232 and the sealing means.

As illustrated in FIG. 5, the sealing component 34 surrounds the mobile electrical conductor 26 with which it is associated. In addition, the sealing component 34 is mounted interdependently with the mobile electrical conductor 26. In this way, the sealing component 34 may for example comprise two parts between which mobile electrical conductor 26 is designed to be inserted and fastening means such as screws 36 to secure the two parts to each other.

As illustrated in FIGS. 4 to 8, the sealing component 34 may correspond to a metal plate extending in a plane substantially parallel to the plane in which the adjacent fixed portion 230 extends.

Still according to the example in FIGS. 4 to 8, a compensating component 38 may be arranged between the metal plate and the mobile electrical conductor 26 which it surrounds.

The electrolytic cell 1 may further comprise means for guiding this metal plate in translation. The guiding means comprise for example two substantially rectangular frames 40, fixed against the fixed portion 230 of the confinement chamber 22 so as to surround the window 232, for example by means of screws 41, and arranged relative to each other so as to define between them a space within which the metal plate is designed to slide. Electrolysis tank 1 may also include expansion compensation means interposed between the two frames, such as a flexible joint that can be sufficiently compressed to bring into contact the sealing component 34 and the frames 40, to provide sealing while allowing sliding between sealing component 34 and frames 40.

As shown in FIGS. 5 to 8 and in FIG. 9, the mobile electrical conductor 26 may have a portion with polygonal section, for example a square or rectangular section, particularly a section of the confinement chamber, so that any rotation of the mobile electrical conductor 26 around the axis in which it extends, in relation to the sealing means, is prevented.

It will be noted that the anode assembly may be fully supported at each end of the support bar 80 by the second portion 260 of the mobile electrical conductor(s) 26, so that no extra support means likely to interact with the confinement chamber 22 are required.

The mobile electrical conductors 26 therefore provide both an electrical connection function with the anode assembly and mechanical support of the anode assembly that moves the anode assembly.

The electrolytic cell 1 may include multiple mobile electrical conductors 26 electrically connected to the same anode support 8, the second portions 260 of these mobile electrical conductors 26 supporting the anode assembly. For example, as illustrated in FIG. 1, 2 or 3, the electrolytic cell 1 may comprise, for each anode support 8, two mobile electrical conductors 26, both arranged on two opposite sides of the electrolytic cell 1. it will be noted that each anode support 8 may have an upstream end 82 electrically connected and supported by the second portion 260 of an upstream mobile electrical conductor 26 and a downstream end 83 electrically connected and supported by a downstream mobile electrical conductor 26.

It is specified that upstream/downstream are defined relative to the overall direction of circulation of the electrolysis current in the line of electrolytic cells.

According to the example in FIG. 10, the electrolytic cell 1 comprises, for each support anode 8, one mobile electrical conductor 26, arranged at one of the two sides of the electrolytic cell 1. Where appropriate, it is the upstream end 82 which is preferably electrically connected and supported by the mobile electrical conductor 26 in order to minimize the overall length of the electrolysis conductor circuit.

As stated above, the mobile electrical conductors 26 are mobile with the anode assembly to which they are electrically connected.

Moreover, it has also been stated that mobile electrical conductors 26 can advantageously mechanically fully support the anode assembly to which they are electrically connected.

To move the anode assembly, the electrolytic cell 1 may include moving means which are advantageously arranged to move the mobile electrical conductor(s) 26 in a vertical translation movement.

This configuration, which involves moving the entire anode assembly not directly but via the mobile electrical conductor 26, makes it possible to arrange the moving means on the outside of the confinement chamber 22, which limits potential interactions with the confinement chamber 22 while limiting exposure of the moving means to the high temperatures and the gases generated by electrolytic cell 1 in operation. For example, as illustrated in FIG. 3, the moving means comprise a separate jack 42 for each mobile electrical conductor 26, one mobile end of which is attached to the first portion 262 of one of the moving electrical conductors 26 supporting the anode assembly. A fixed part of the jack 42 may be attached to a fixed element, for example to the fixed portion 230 of the confinement chamber 22, especially to the pot shell 2 or to the wall 231. Each mobile electrical conductor 26 is moved by separate moving means and more particularly by a separate jack 42. The means for moving the different anode assemblies are therefore separate.

According to the example in FIG. 10, showing an electrolytic cell 1 with the mobile electrical conductors 26 arranged on a single side of the electrolytic cell 1, the moving means may comprise, on that side of the electrolytic cell 1 and similarly, a jack 42 having one end attached to the fixed portion 230 of the confinement chamber 22, while the end of the jack 42 is attached to the first portion 262 of the corresponding mobile electrical conductor 26 supporting the anode assembly. On the other side of the electrolytic cell 1, i.e. the one that has no mobile electrical conductor 26, the moving means may include a jack 43 and a remote mobile 45 support, guided vertically and supporting the anode assembly. Sealing means similar to those described above may be provided around the support 45.

Note that the second portion 260 of each mobile electrical conductor 26 may be arranged under the anode support 8 of the anode assembly, so that it can rest by gravity on the second portion 260 of the mobile electrical conductors 26.

In addition, the mobile electrical conductor(s) 26 may extend under the anode support 8 of the anode assembly without extending above and in line with the corresponding anode assembly.

This allows replacement of the anode assembly without the mobile electrical conductors 26 impeding the replacement, with a simple lifting movement of the anode assembly and without manipulating any moving electrical conductors 26 which could be detrimental to sealing the confinement chamber 22.

To improve sealing of the confinement chamber 22, particularly at the junction between the mobile top portion 220 and the fixed side portion 230, provision can be made for the electrolytic cell 1 to comprise sealing means interposed between the top portion 220 and the fixed portion 230 on which the top portion 220 rests at least in part. The sealing means may comprise a static seal 44 sandwiched between the top portion 220 and the fixed portion 230.

Furthermore, the electrolytic cell 1 may include compression means, such as a screw system, designed to keep the top portion 220 pressed against the fixed portion 230.

As can be seen in FIGS. 4 and 11, the top portion 220 may include a plurality of adjacent hoods 222 substantially longitudinal and parallel, extending in a substantially transverse direction X of the electrolytic cell 1 between two opposite longitudinal edges of the electrolytic cell 1.

The support means are for example beams 46 extending in the substantially transverse direction X of the electrolytic cell 1. These beams 46 may be part of the superstructure.

They prevent warping of the hoods 222 which may affect the sealing of the confinement chamber 22.

Note that the beams 46 may also support additional devices such as chipping-out and feeder devices.

The invention also relates to an aluminum works comprising at least one electrolytic cell 1 according to the invention.

The electrolytic cells of this aluminum works form a line and are arranged transversely to the length of this line.

Of course the invention is not in any way limited to the embodiment described above, this embodiment only being provided by way of example. Modifications are possible, in particular from the point of view of the constitution of the various components, or through replacement by technical equivalents, without thereby going beyond the scope of protection of the invention.

The invention claimed is:

1. An electrolytic cell, for production of aluminum by electrolysis, comprising a pot shell having an inner lining defining an opening, an anode assembly mobile in relation to the pot shell and designed to be removed and replaced periodically, the anode assembly comprising an anode support to which is suspended an anode block designed to be moved through the opening during the aluminum production, and a confinement chamber defining a closed volume above said opening for containment of gases generated during the production of aluminum, the anode support being connected to a mobile electrical conductor that is not configured to be removed and replaced periodically with the anode assembly to supply an electrolysis current to said anode block while the anode block is being moved, characterized in that the anode assembly is fully contained in the confinement chamber, and in that an electrical connection between the mobile electrical conductor and the anode support is made within the confinement chamber.

2. An electrolytic cell according to claim 1, characterized in that the mobile electrical conductor extends into the confinement chamber outside a volume defined by the top of the anode block during movement of the anode block through the opening.

3. An electrolytic cell according to claim 1, characterized in that the confinement chamber comprises a top portion acting as a lid, said top portion being mobile to allow the anode assembly to be extracted.

4. An electrolytic cell according to claim 1, characterized in that the mobile electrical conductor is mobile and in that the confinement chamber comprises a fixed portion having a window through which extends the mobile electrical conductor, the mobile electrical conductor comprising a first portion extending outside the confinement chamber and a second portion extending within the confinement chamber which is electrically connected to the anode support.

5. An electrolytic cell according to claim 4, characterized in that the electrolytic cell comprises sealing means to prevent gases generated during an electrolysis reaction from leaving the confinement chamber via the window through which the mobile electrical conductor passes.

6. An electrolytic cell according to claim 5, characterized in that the mobile electrical conductor passes through the fixed portion of the confinement chamber in a substantially vertical way, and the sealing means include a dynamic seal around the mobile electrical conductor.

7. An electrolytic cell according to claim 6, characterized in that the mobile electrical conductor passes through a horizontal part of the fixed portion.

8. An electrolytic cell according to claim 6, characterized in that the mobile electrical conductor comprises, between the second portion and the first portion, a rectilinear sealing portion of constant section.

9. An electrolytic cell according to claim 5, characterized in that the mobile electrical conductor passes through the fixed portion of the confinement chamber in a substantially horizontal way, and the sealing means include a sealing component configured to completely close the window, whatever the position of the mobile electrical conductor through the window.

10. An electrolytic cell according to claim 9, characterized in that the sealing component surrounds the mobile electrical conductor and is mounted interdependently with the mobile electrical conductor.

11. An electrolytic cell according to claim 10, characterized in that the sealing component is a metal plate extending in a plane substantially parallel to the fixed portion through which the mobile electrical conductor passes.

12. An electrolytic cell according to claim 10, characterized in that a compensating component is arranged between the sealing component and the mobile electrical conductor.

13. An electrolytic cell according to claim 10, characterized in that the electrolytic cell comprises means for guiding the sealing component in translation, the guiding means comprising two substantially rectangular frames fixed against the fixed portion of the confinement chamber so as to surround the window of the fixed portion and arranged relative to each other so as to define between the frames a space within which the sealing component is designed to slide, the electrolytic cell further comprising means for expansion compensation interposed between the two frames.

14. An electrolytic cell according to claim 1, characterized in that the mobile electrical conductor is a non-deformable rigid mobile electrical conductor.

15. An electrolytic cell according to claim 1, characterized in that the anode assembly is supported by the mobile electrical conductor and moved via the mobile electrical conductor.

16. An electrolytic cell according to claim 15, characterized in that the electrolytic cell comprises moving means for moving the mobile electrical conductor in substantially vertical translation, the moving means being arranged entirely outside the confinement chamber.

17. An electrolytic cell according to claim 16, characterized in that the moving means comprise a jack specifically associated with the mobile electrical conductor acting as a support for the anode assembly.

18. An electrolytic cell according to claim 1, characterized in that the mobile electrical conductor does not extend in line above said anode assembly.

19. An electrolytic cell according to claim 18, characterized in that the mobile electrical conductor is arranged under the anode support of the anode assembly.

20. An electrolytic cell according to claim 4, characterized in that the confinement chamber comprises a top portion acting as a lid and that the top portion of the confinement chamber rests on the fixed portion of the confinement chamber.

21. An electrolytic cell according to claim 20, characterized in that the fixed portion defines a substantially rectangular horizontal opening and the top portion rests substantially horizontally on the fixed portion.

22. An electrolytic cell according to claim 20, characterized in that the top portion may include a plurality of adjacent hoods substantially longitudinal and parallel to each other, extending in a substantially transverse direction of the electrolytic cell between two opposite longitudinal edges of the electrolytic cell.

23. An electrolytic cell according to claim 20, characterized in that the fixed portion of the confinement chamber comprises a vertical portion extending substantially vertically around and above the opening defined by the pot shell and the inner lining.

24. An electrolytic cell according to claim 1, characterized in that the electrolytic cell comprises means of fixing the anode support onto the mobile electrical conductor, the fixing means being completely contained inside the confinement chamber.

25. An electrolytic cell according to claim 1, characterized in that the electrolytic cell comprises a plurality of the anode assemblies and a plurality of the mobile electrical conductors and, for each anode assembly, at least one of the plurality of mobile electrical conductors electrically connected to the anode support.

26. An electrolytic cell according to claim 1, characterized in that the anode support comprises a bar extending substantially horizontally between two opposite longitudinal edges of the electrolytic cell.

27. An electrolytic cell according to claim 26, characterized in that the electrolytic cell comprises at least two of the mobile electrical conductors, and each of the opposite ends of the bar is electrically connected to one of the mobile electrical conductors.

28. An electrolytic cell according to claim 27, characterized in that each of the opposite ends of the bar is supported by the mobile electrical conductor and moved via the mobile electrical conductor.

29. An electrolytic cell according to claim 1, characterized in that the mobile electrical conductor has a portion of polygonal section.

30. An aluminum works including a plurality of electrolytic cells according to claim 1.

31. An electrolytic cell according to claim 1, characterized in that the mobile electrical conductor is arranged under the anode support of the anode assembly and extends downward from the anode support.

32. An electrolytic cell according to claim 1, characterized in that the electrical connection between the mobile electrical conductor and the anode support is made within the confinement chamber at a location that is horizontally offset from the anode block.

33. An electrolytic cell, for production of aluminum by electrolysis, comprising a pot shell having an inner lining defining an opening, an anode assembly mobile in relation to the pot shell and designed to be removed and replaced periodically, the anode assembly comprising an anode support to which is suspended an anode block designed to be moved through the opening during the aluminum production, and a confinement chamber defining a closed volume above said opening for containment of gases generated during the production of aluminum, the anode support being connected to a mobile electrical conductor that is not configured to be removed and replaced periodically with the anode assembly to supply an electrolysis current to said anode block while the anode block is being moved, characterized in that the anode assembly is fully contained in the confinement chamber, and in that the electrical connection between the mobile electrical conductor and the anode support is made within the confinement chamber, wherein the confinement chamber comprises a top portion acting as a lid, said top portion being mobile to allow the anode assembly to be extracted, and a fixed portion having a window through which the mobile electrical conductor extends from outside the confinement chamber.

* * * * *